US007712590B1

(12) United States Patent
Lee

(10) Patent No.: US 7,712,590 B1
(45) Date of Patent: May 11, 2010

(54) LUGGAGE GRIP HAVING SIMPLIFIED CONSTRUCTION

(75) Inventor: Yu-Wen Lee, Changhua Hsien (TW)

(73) Assignee: Hando Industrial Co., Ltd., Yuanlin Town (TW)

( * ) Notice: Subject to any disclaimer, the term of this patent is extended or adjusted under 35 U.S.C. 154(b) by 175 days.

(21) Appl. No.: 11/964,247

(22) Filed: Dec. 26, 2007

(51) Int. Cl.
*B60R 25/10* (2006.01)

(52) U.S. Cl. ..... 190/115; 190/100; 190/39; 16/405; 16/110.1; 16/903; 16/111.1; 16/412; 16/444

(58) Field of Classification Search ..... 190/115, 190/100, 39; 16/405, 110.1, 903, 111.1, 16/412, 444
See application file for complete search history.

(56) References Cited

U.S. PATENT DOCUMENTS

| | | | | | |
|---|---|---|---|---|---|
| 311,650 | A * | 2/1885 | Drew | 251/183 |
| 2,987,151 | A * | 6/1961 | Frambes | 16/405 |
| 3,113,650 | A * | 12/1963 | Szabo | 190/115 |
| 3,219,160 | A * | 11/1965 | Szabo | 190/115 |
| 3,289,798 | A * | 12/1966 | Gehrie | 190/115 |
| 3,566,436 | A * | 3/1971 | Marks | 16/405 |
| 4,134,480 | A * | 1/1979 | Davis | 16/405 |
| 4,280,247 | A * | 7/1981 | Burzen et al. | 16/409 |
| 4,357,734 | A * | 11/1982 | Moore | 16/442 |
| 5,771,537 | A * | 6/1998 | Ho | 16/410 |
| 6,374,457 | B1 * | 4/2002 | Kuo | 16/113.1 |
| 6,553,629 | B2 * | 4/2003 | Grady et al. | 16/444 |
| 6,668,424 | B1 * | 12/2003 | Allen et al. | 16/444 |
| 6,735,824 | B2 * | 5/2004 | Tisol Jr. et al. | 16/412 |
| 6,895,635 | B2 * | 5/2005 | Tisol et al. | 16/110.1 |
| 7,270,359 | B2 * | 9/2007 | Sparks et al. | 296/1.02 |
| 7,378,604 | B2 * | 5/2008 | Truong | 177/131 |
| 7,400,232 | B2 * | 7/2008 | Reichling et al. | 340/426.36 |
| 2001/0034923 | A1 * | 11/2001 | Ho | 16/114.1 |
| 2004/0182667 | A1 * | 9/2004 | Lin | 190/115 |

* cited by examiner

*Primary Examiner*—Anthony Stashick
*Assistant Examiner*—Cynthia F Collado
(74) *Attorney, Agent, or Firm*—Alan Kamrath; Kamrath & Associates PA

(57) ABSTRACT

A luggage grip includes two fixing seats spaced from each other, and a flexible holding bar mounted between the two fixing seats and having two opposite end portions each movably mounted on the respective fixing seat. Thus, the holding bar is pulled upward to have a curved shape for use with the user and is retractable to have a flat shape when not in use, thereby facilitating the user operating and folding the holding bar. In addition, the luggage grip has a simplified construction to decrease the cost of fabrication. Further, the luggage grip is assembled easily and quickly.

12 Claims, 3 Drawing Sheets

LUGGAGE GRIP HAVING SIMPLIFIED CONSTRUCTION

BACKGROUND OF THE INVENTION

1. Field of the Invention

The present invention relates to a grip and, more particularly, to a grip for a luggage to facilitate a user holding the grip to lift the luggage.

2. Description of the Related Art

A conventional luggage grip is mounted on the top of a luggage and has a hollow inside to facilitate a user holding the luggage grip to lift the luggage. However, the luggage grip protrudes from the top of the luggage, so that the luggage has a larger volume, thereby causing inconvenience to the user in storage and transportation of the luggage. In addition, the luggage grip protrudes from the luggage, so that the luggage grip easily interferes with other luggage.

BRIEF SUMMARY OF THE INVENTION

In accordance with the present invention, there is provided a luggage grip, comprising two fixing seats spaced from each other, and a flexible holding bar mounted between the two fixing seats and having two opposite end portions each movably mounted on the respective fixing seat.

The primary objective of the present invention is to provide a luggage grip that has a simplified construction to decrease the cost of fabrication.

Another objective of the present invention is to provide a luggage grip that is assembled easily and quickly.

A further objective of the present invention is to provide a luggage grip that is mounted on the luggage easily and quickly to facilitate a user mounting the luggage grip.

A further objective of the present invention is to provide a luggage grip, wherein the holding bar is pulled upward to have a curved shape for use with the user and is retractable to have a flat shape when not in use, thereby facilitating the user operating and folding the holding bar.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
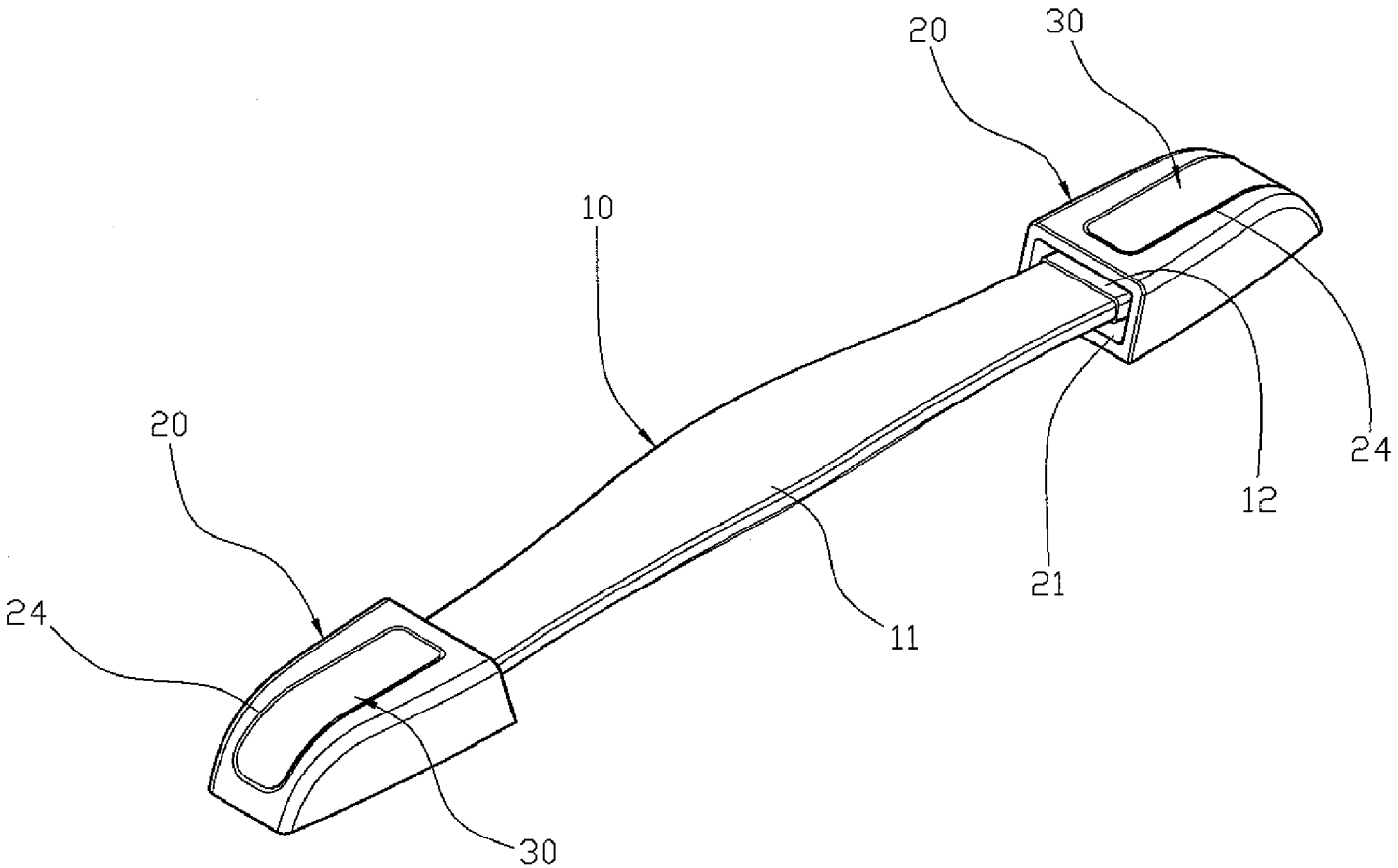
FIG. 1 is a perspective view of a luggage grip in accordance with the preferred embodiment of the present invention.
Figure 2:
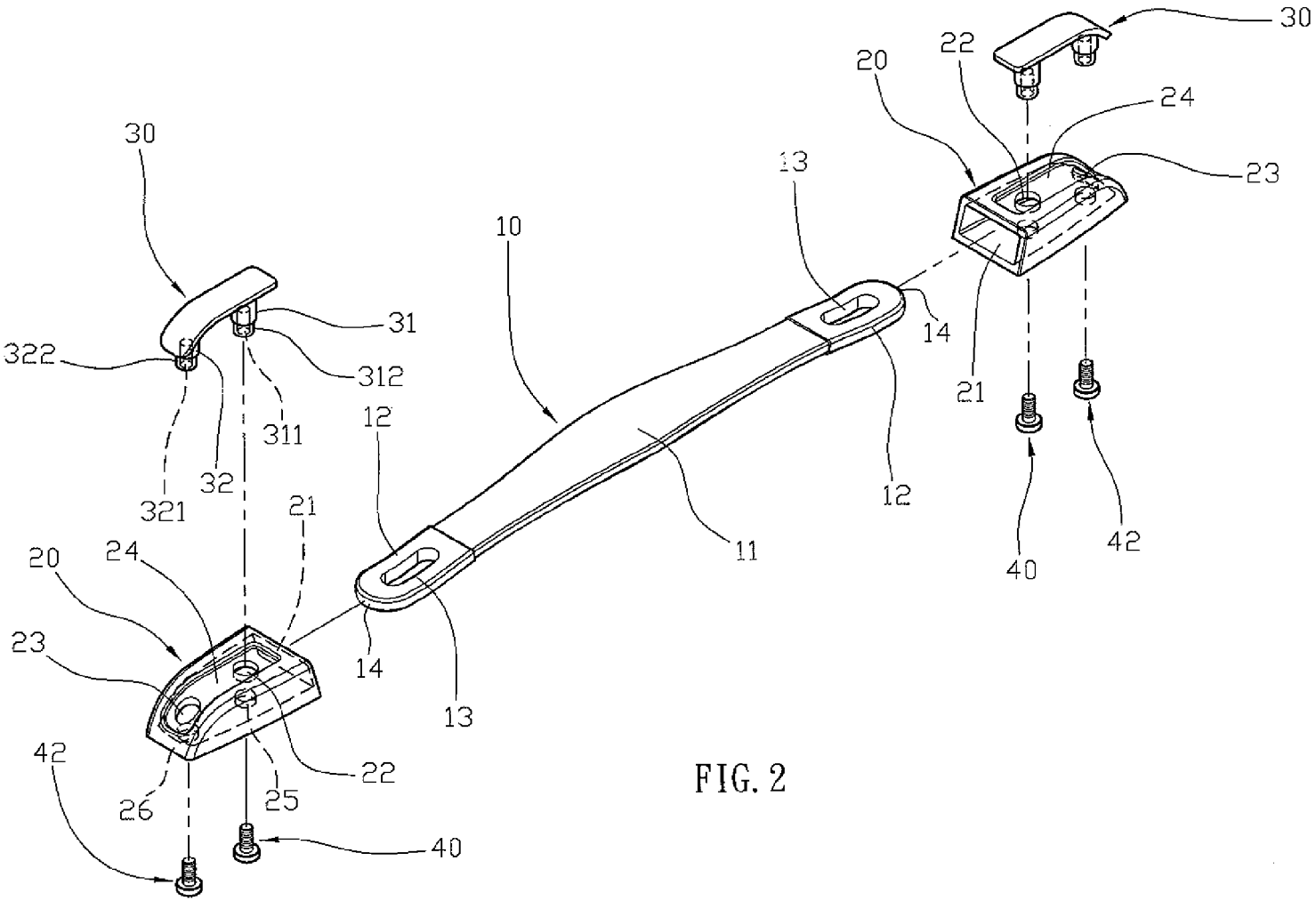
FIG. 2 is an exploded perspective view of the luggage grip as shown in FIG. 1.
Figure 3:
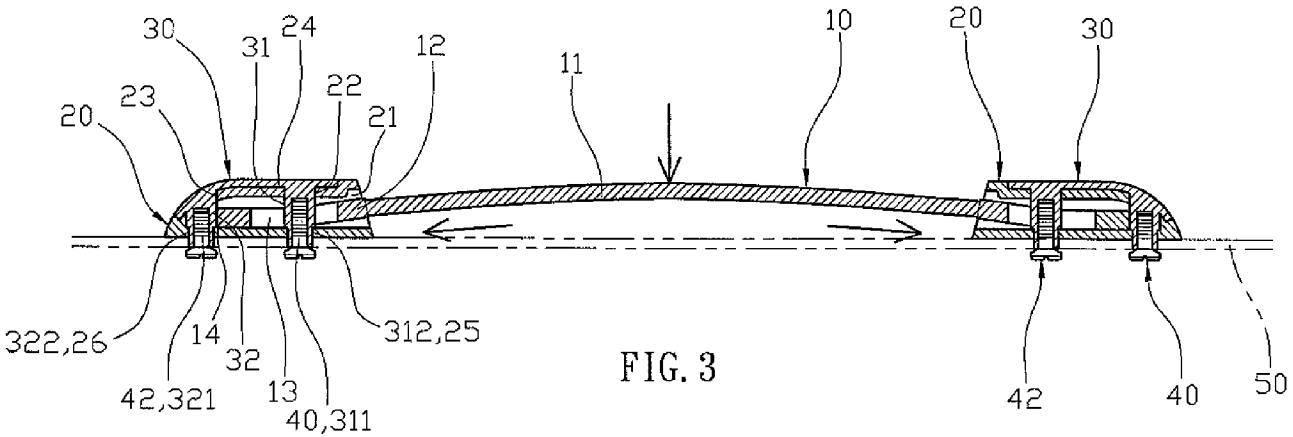
FIG. 3 is a front cross-sectional view of the luggage grip as shown in FIG. 1.

Referring to the drawings and initially to FIGS. 1-3, a luggage grip in accordance with the preferred embodiment of the present invention comprises two fixing seats 20 mounted on a luggage 50 and spaced from each other, and a flexible holding bar 10 mounted between the two fixing seats 20 and having two opposite end portions 12 each movably mounted on the respective fixing seat 20.

Each of the two fixing seats 20 has an inside provided with a receiving chamber 21, and each of the two end portions 12 of the holding bar 10 is slidable in the receiving chamber 21 of the respective fixing seat 20. Each of the two end portions 12 of the holding bar 10 is provided with an elongate guide slot 13. The holding bar 10 has a mediate portion provided with an enlarged holding portion 11 located between the two end portions 12.

The luggage grip further comprises two fastening members 30 each mounted on the respective fixing seat 20 and each provided with a protruding limit rod 31 extending through the respective fixing seat 20 and the guide slot 13 of the respective end portion 12 of the holding bar 10 so that the guide slot 13 of each of the two end portions 12 of the holding bar 10 is slidable on the limit rod 31 of the respective fastening member 30 when each of the two end portions 12 of the holding bar 10 is slidable in the receiving chamber 21 of the respective fixing seat 20. The limit rod 31 of each of the two fastening members 30 has an inside provided with a screw bore 311 and has a distal end provided with a mounting portion 312 protruding outwardly from the respective fixing seat 20. The mounting portion 312 of each of the two fastening members 30 has a diameter smaller than that of the limit rod 31. Each of the two fastening members 30 is further provided with a protruding stop rod 32 extending through the respective fixing seat 20 into the receiving chamber 21 of the respective fixing seat 20 and abutting an end face 14 of the respective end portion 12 of the holding bar 10 when each of the two end portions 12 of the holding bar 10 is slidable in the receiving chamber 21 of the respective fixing seat 20. The stop rod 32 of each of the two fastening members 30 has an inside provided with a screw hole 321 and has a distal end provided with a mounting section 322 protruding outwardly from the respective fixing seat 20. The mounting section 322 of each of the two fastening members 30 has a diameter smaller than that of the stop rod 32.

Each of the two fixing seats 20 has a first side provided with a through hole 22 connected to the receiving chamber 21 to allow passage of the limit rod 31 of the respective fastening member 30 and a through bore 23 connected to the receiving chamber 21 to allow passage of the stop rod 32 of the respective fastening member 30. The first side of each of the two fixing seats 20 has a periphery provided with a receiving groove 24 to receive the respective fastening member 30. The receiving groove 24 of each of the two fixing seats 20 has a shape and dimension corresponding that of the respective fastening member 30 so that the respective fastening member 30 is fully hidden in the receiving groove 24 of each of the two fixing seats 20.

Each of the two fixing seats 20 has a second side provided with a retaining hole 25 connected to the receiving chamber 21 to allow passage of the mounting portion 312 of the respective fastening member 30 and a retaining bore 26 connected to the receiving chamber 21 to allow passage of the mounting section 322 of the respective fastening member 30. The retaining hole 25 of each of the two fixing seats 20 has a diameter smaller than that of the limit rod 31 of the respective fastening member 30 to retain the limit rod 31 of the respective fastening member 30. The retaining bore 26 of each of the two fixing seats 20 has a diameter smaller than that of the stop rod 32 of the respective fastening member 30 to retain the stop rod 32 of the respective fastening member 30.

The luggage grip further comprises two locking screws 40 each screwed into the screw bore 311 of the respective fastening member 30 and abutting the mounting portion 312 of the respective fastening member 30, and two retaining screws 42 each screwed into the screw hole 321 of the respective fastening member 30 and abutting the mounting section 322 of the respective fastening member 30.

As shown in FIG. 3, each of the two end portions 12 of the holding bar 10 is retractable into and fully hidden in the receiving chamber 21 of the respective fixing seat 20 when the holding bar 10 is disposed at a flat state.

Figure 4:
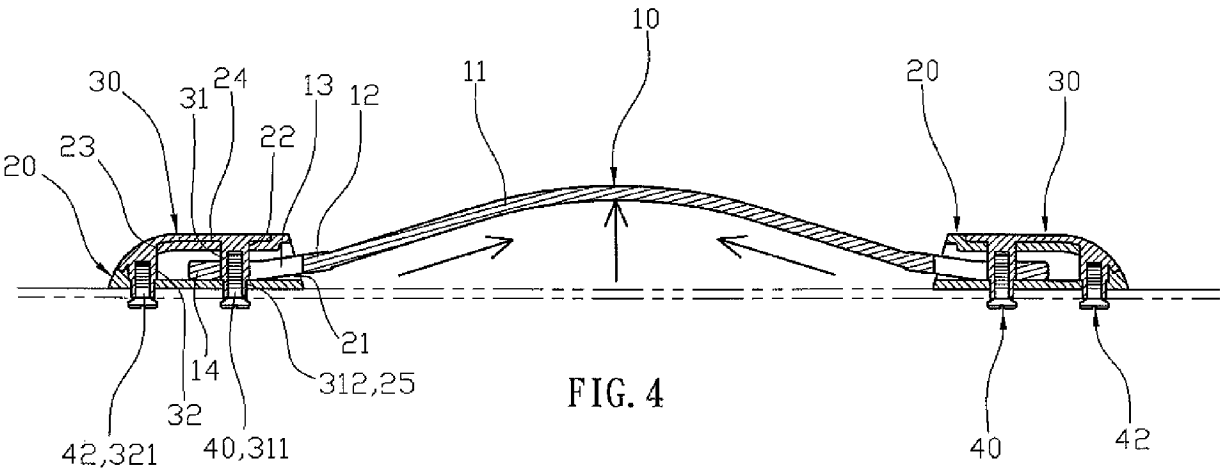
FIG. 4 is a schematic operational view of the luggage grip as shown in FIG. 3 in use.

As shown in FIG. 4, the guide slot 13 of each of the two end portions 12 of the holding bar 10 is slidable on the limit rod 31 of the respective fastening member 30 so that each of the two end portions 12 of the holding bar 10 is extendable outwardly from the receiving chamber 21 of the respective fixing seat 20 when the holding bar 10 is pulled upward and disposed at a curved state to facilitate a user holding the holding portion 11 of the holding bar 10.

Accordingly, the luggage grip has a simplified construction to decrease the cost of fabrication. In addition, the luggage grip is mounted on the luggage 50 easily and quickly to facilitate a user mounting the luggage grip. Further, the holding bar 10 is pulled upward to have a curved shape for use with the user and is retractable to have a flat shape when not in use, thereby facilitating the user operating and folding the holding bar 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A luggage grip, comprising:

two fixing seats spaced from each other;

a flexible holding bar mounted between the two fixing seats and having two opposite end portions each movably mounted on the respective fixing seat; wherein each of the two fixing seats has an inside provided with a receiving chamber;

each of the two end portions of the holding bar is slidable in the receiving chamber of the respective fixing seat;

each of the two end portions of the holding bar is provided with an elongate guide slot;

the luggage grip further comprises two fastening members each mounted on the respective fixing seat and each provided with a protruding limit rod extending extending through the respective fixing seat and the guide slot of the respective end portion of the holding bar;

the guide slot of each of the two end portions of the holding bar is slidable on the limit rod of the respective fastening member when each of the two end portions of the holding bar is chamber of the respective fixing seat;

the limit rod of each of the two fastening members has a distal end provided with a mounting portion protruding outwardly from the respective fixing seat;

each of the two fastening members is provided with a protruding stop rod extending through the respective fixing seat into the receiving chamber of the respective fixing seat and abutting an end face of the respective end portion of the holding bar when each of the two end portions of the holding bar is slidable in the receiving chamber of the respective fixing seat;

the stop rod of each of the two fastening members has a distal end provided with a mounting section protruding outwardly from the respective fixing seat;

each of the two fixing seats has a first side provided with a through hole connected to the receiving chamber to allow passage of the limit rod of the respective fastening member and a through bore connected to the receiving chamber to allow passage of the stop rod of the respective fastening member;

the first side of each of the two fixing seats has a periphery provided with a receiving groove to receive the respective fastening member.

2. The luggage grip in accordance with claim 1, wherein the mounting portion of each of the two fastening members has a diameter smaller than that of the limit rod.

3. The luggage grip in accordance with claim 1, wherein the mounting section of each of the two fastening members has a diameter smaller than that of the stop rod.

4. The luggage grip in accordance with claim 1, wherein the receiving groove of each of the two fixing seats has a shape and dimension corresponding that of the respective fastening member;

the respective fastening member is fully hidden in the receiving groove of each of the two fixing seats.

5. The luggage grip in accordance with claim 1, wherein each of the two fixing seats has a second side provided with a retaining hole connected to the receiving chamber to allow passage of the mounting portion of the respective fastening member and a retaining bore connected to the receiving chamber to allow passage of the mounting section of the respective fastening member.

6. The luggage grip in accordance with claim 5, wherein the retaining hole of each of the two fixing seats has a diameter smaller than that of the limit rod of the respective fastening member to retain the limit rod of the respective fastening member.

7. The luggage grip in accordance with claim 5, wherein the retaining bore of each of the two fixing seats has a diameter smaller than that of the stop rod of the respective fastening member to retain the stop rod of the respective fastening member.

8. The luggage grip in accordance with claim 1, wherein the limit rod of each of the two fastening members has an inside provided with a screw bore;

the luggage grip further comprises two locking screws each screwed into the screw bore of the respective fastening member and abutting the mounting portion of the respective fastening member.

9. The luggage grip in accordance with claim 1, wherein the stop rod of each of the two fastening members has an inside provided with a screw hole;

the luggage grip further comprises two retaining screws each screwed into the screw hole of the respective fastening member and abutting the mounting section of the respective fastening member.

10. The luggage grip in accordance with claim 1, wherein each of the two end portions of the holding bar is retractable into and fully hidden in the receiving chamber of the respective fixing seat when the holding bar is disposed at a flat state.

11. The luggage grip in accordance with claim 1, wherein each of the two end portions of the holding bar is extendable outwardly from the receiving chamber of the respective fixing seat when the holding bar is pulled upward and disposed at a curved state.

12. The luggage grip in accordance with claim 1, wherein the holding bar has a mediate portion provided with an enlarged holding portion located between the two end portions.

* * * * *